US006688266B1

(12) United States Patent
Church et al.

(10) Patent No.: US 6,688,266 B1
(45) Date of Patent: Feb. 10, 2004

(54) PRESSURIZED SEALING GROOVE FOR DEACTIVATING ROLLER-FOLLOWER

(75) Inventors: Kynan L. Church, Ceresco, MI (US); John A. Ness, Birmingham, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/390,482

(22) Filed: Mar. 17, 2003

(51) Int. Cl.[7] ..... F01L 1/34

(52) U.S. Cl. ..... 123/90.16; 123/90.44; 123/90.52; 123/90.55

(58) Field of Search ..... 123/90.15, 90.16, 123/90.17, 90.39, 90.44, 90.45, 90.46, 90.48, 90.49, 90.52, 90.55, 198 F

(56) References Cited

U.S. PATENT DOCUMENTS 6,196,175 B1 * 3/2001 Church ..... 123/90.16
6,321,704 B1 * 11/2001 Church et al. ..... 123/90.16
6,427,652 B2 * 8/2002 Faria et al. ..... 123/90.16
6,606,972 B2 * 8/2003 Wenisch et al. ..... 123/90.17

* cited by examiner

*Primary Examiner*—Thomas Denion
*Assistant Examiner*—Ching Chang
(74) *Attorney, Agent, or Firm*—L. J. Kasper

(57) ABSTRACT

A valve deactivation assembly (21) comprises part of the valve gear train for an internal combustion engine, and is disposed in a bore (55) defined by the A engine block (11B). The assembly (21) includes a latching mechanism (67) shiftable, in response to control fluid pressure, between latched and unlatched conditions. The assembly (21) includes an outer body member (53), having an outer cylindrical surface (53S), reciprocable within said the bore (55), the outer body member including a lower terminal portion (55L). The outer body member defines an annular sealing groove (75) which remains aligned within the bore (55), between the lower terminal portion (55L) and a passage (72) communicating control fluid pressure the latching mechanism (67), as the outer body member reciprocates. There is also a fluid passage (77) disposed to communicate a source (79) of low pressure to the annular groove (75), to thereby form a barrier to block the migration of air to the control pressure passage (72).

7 Claims, 4 Drawing Sheets

PRESSURIZED SEALING GROOVE FOR DEACTIVATING ROLLER-FOLLOWER

BACKGROUND OF THE DISCLOSURE

The present invention relates to an improved valve gear train for an internal combustion engine, and more particularly, to a valve deactivator sub-assembly for use therein.

Although the valve deactivator sub-assembly of the present invention may be utilized to introduce some additional lash into the valve train, such that the valves open and close by an amount less than the normal opening and closing, the invention is especially suited for introducing into the valve train sufficient lash (also referred to hereinafter as "lost motion"), such that the valves no longer open and close at all, and the invention will be described in connection therewith.

Valve deactivators of the general type to which the invention relates are known, especially in connection with internal combustion engines having a push rod type valve gear train in which there is a rocker arm, with one end of the rocker arm engaging the push rod, and the other end engaging the engine poppet valve. Typically, a central portion of the rocker arm is fixed relative to the cylinder head (or other suitable structure) by a fulcrum arrangement as is well know to those skilled in the art, in which the fulcrum normally prevents movement of the central portion of the rocker arm in an "up and down" direction. At the same time, the fulcrum permits the rocker arm to engage in cyclical, pivotal movement, in response to the cyclical motion of the push rod, which results from the engagement of the push rod with the lobes of the rotating cam shaft.

There are a number of known valve deactivator sub-assemblies which are operably associated with the fulcrum portion of the rocker arm and which, in the latched condition, restrain the fulcrum portion of the rocker arm to move in its normal cyclical, pivotal movement. However, In an unlatched condition, the valve deactivator sub-assembly permits the fulcrum portion of the rocker arm to engage in "lost motion" such that the cyclical, pivotal movement of the push rod causes the rocker arm to undergo cyclical, pivotal movement about the end which is in engagement with the engine poppet valve. In other words, the rocker arm merely pivots, but the engine poppet valve does not move and therefore, is in its deactivated condition.

Although the known valve deactivator sub-assemblies of the type referred to above have performed in a generally satisfactory manner, such sub-assemblies do add substantially to the overall cost of the valve gear train, and in many cases also add undesirably to the space taken up by the overall rocker arm installation. In some engine designs, there is simply no room to add a valve deactivator sub-assembly of the type which is associated with the rocker arm fulcrum member.

Typically, in a push rod type of valve gear train, there is some sort of cam follower device having one portion thereof in engagement with the cam lobe on the engine cam shaft, and another portion thereof in engagement with the lower end of the push rod. It is also known for such a cam follower mechanism to include a hydraulic lash compensation element. It is now also known to incorporate a valve deactivator mechanism into the cam follower, thus eliminating the need for adding to the rocker arm assembly the type of expensive, space consuming deactivator structure described above, for use with a rocker arm fulcrum member.

On a normal internal combustion engine having valve gear train of the push rod type, as described above, and including some form of valve deactivation capability, it would be typical for less than all of the engine poppet valves to be equipped with the valve deactivation capability. In other words, on an eight cylinder engine, by way of example only, it would be typical to provide valve deactivation capability on both the intake and exhaust valves of four of the eight cylinders, while equipping the intake and exhaust valves of the other four cylinders with conventional roller followers.

The valve deactivating cam followers of the type to which the present invention relates typically include some sort of latching mechanism, operable to latch the follower, so that rotation of the camshaft results in cyclical up and down motion of the follower (and of the push rod). The latching mechanism is also operable to be in an unlatched condition of the cam follower, thus introducing lost motion into the valve gear train, so that rotation of the camshaft results in no up and down motion of the cam follower (and no up and down motion of the push rod). Typically, although the present invention is not so limited, the latching mechanism includes a radially moveable latch member, perhaps biased radially outwardly by a biasing spring, toward the latched condition. In that case, unlatching is accomplished by communicating pressurized control fluid through a control passage in the engine block to the bore in which the cam follower reciprocates, where the control pressure biases the latch member radially inward, in opposition to the biasing force of the spring, to the unlatched condition. A valve deactivating roller follower of the type described above is known from U.S. Pat. No. 6,196,175, assigned to the assignee of the present invention and incorporated herein by reference.

Although valve deactivating cam followers of the type described above are starting to achieve commercial use, and are performing well, the environment in which such cam followers operate inherently results in certain problems. In connection with the development of the present invention, it has been observed that, occasionally, the response time of the cam follower (i.e., the time to change between the latched and unlatched conditions) is much slower than anticipated, and much slower than is required for optimum engine operation. It has also been observed that the sudden, substantial increase in the response time of the cam followers is generally accompanied by the presence of air in the pressurized fluid in the control passage. Typically, the "lower" end of the cam follower, i.e., the end where the roller is mounted, is disposed adjacent an opening in the engine block, with the camshaft being disposed in this opening, and engaging the roller of the cam follower.

BRIEF SUMMARY OF THE INVENTION

Accordingly, it is an object of the present invention to provide an improved valve deactivation assembly which overcomes the above-described disadvantages of the prior art.

It is a more specific object of the present invention to provide an improved valve deactivation assembly, especially suited for use in push rod type valve gear train, wherein the deactivation assembly does not encounter such occasional, substantial increases in response time.

It is another object of the present invention to provide an improved valve deactivation assembly which accomplishes the above-stated objects by minimizing the ability of air to pass from the opening surrounding the camshaft to the control fluid passage containing the pressurized fluid used to control the latching mechanism.

The above and other objects of the invention are accomplished by the provision of an improved valve deactivation assembly for an internal combustion engine of the type having valve means for controlling flow to and from a combustion chamber. A drive means provides cyclical motion for opening and closing the valve means in timed relationship to the events in the combustion chamber. A valve gear train is operative in response to the cyclical motion to effect cyclical opening and closing of the valve means. The valve deactivation assembly comprises part of the valve gear train and is disposed in a bore defined by the internal combustion engine, and includes latching means shiftable between latched and unlatched conditions in response to the presence of a control fluid pressure in a control passage intersecting the bore. The valve deactivation assembly includes an outer body member disposed for reciprocable movement in the bore in response to the cyclical motion of the drive means.

The improved valve deactivation assembly is characterized by the bore defining a lower terminal portion disposed adjacent the drive means. The other body member defines on its outer surface a fluid chamber extending about substantially the entire circumferential extent of the outer surface, the fluid chamber remaining aligned with the bore, between the lower terminal portion of the bore and the control passage as the outer body member engages in the reciprocable movement. One of the outer body member and the bore defines a fluid passage disposed to communicate between a source of fluid pressure and the fluid chamber to form a barrier to substantially block (or "seal") the migration of air from the lower terminal portion of the bore to the control passage in association with reciprocable movement of the outer body member.

DETAILED DESCRIPTION OF THE PREFERRED EMBODIMENT

Figure 1:
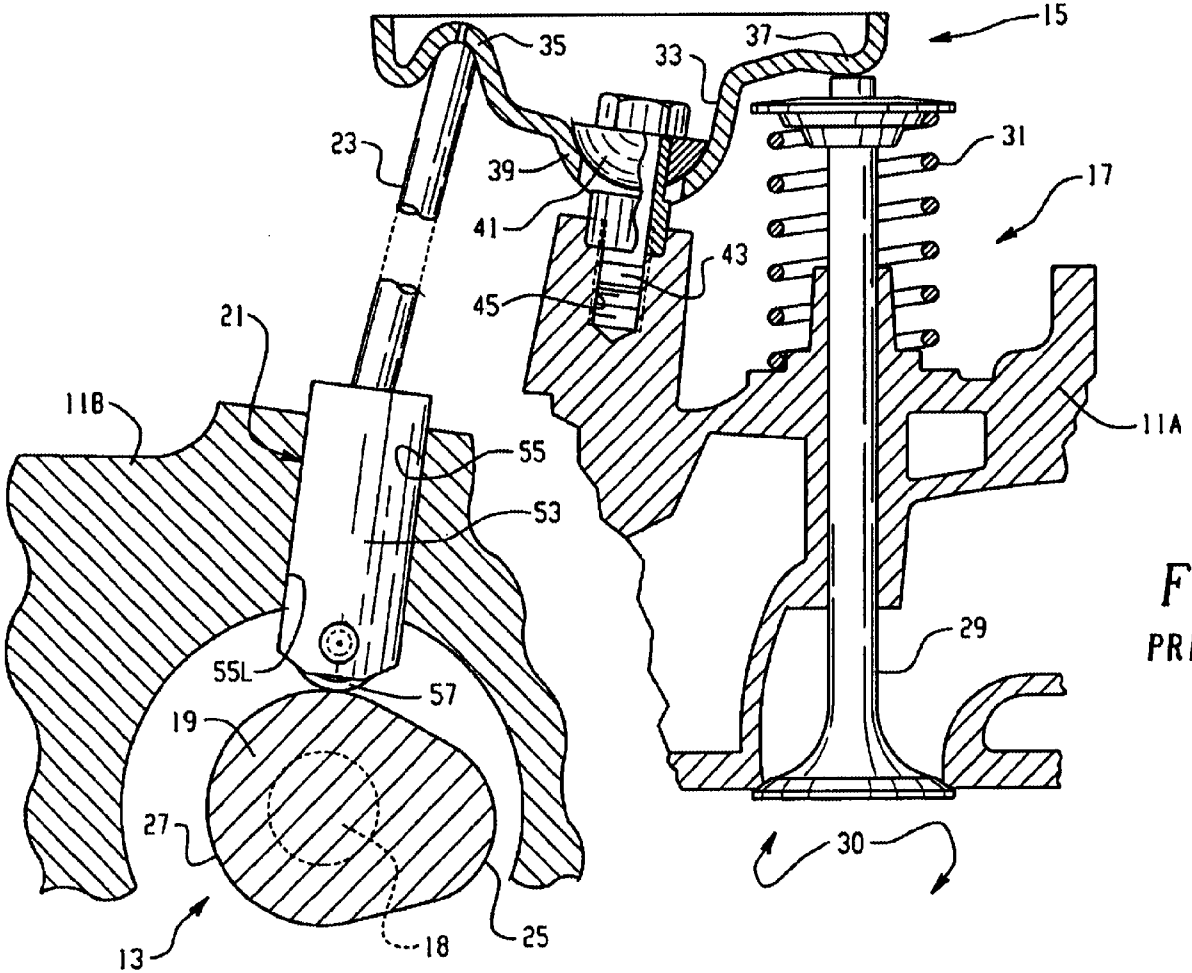
Fig. 1 PRIOR ART
FIG. 1 is a fragmentary, axial cross section taken through a vehicle internal combustion engine, illustrating a typical ("Prior Art") valve gear train of the type with which the present invention may be utilized.

Referring now to the drawings, which are not intended to limit the invention, FIG. 1 illustrates a valve actuating valve gear train of the push rod type, although it should be understood that the use of the present invention is not strictly limited to such. FIG. 1 illustrates, fragmentarily, a cylinder head 11A and an engine block 11B. Within the engine block 11B is mounted a drive assembly 13, and on the cylinder head 11A is mounted a rocker arm assembly 15, and an engine poppet valve assembly, generally designated 17. Those skilled in the art will understand that the spatial relationship of the cylinder head 11A and engine block 11B, as shown in FIG. 1 is for ease of illustration only.

The drive assembly 13 includes a cam shaft 18 having a cam 19, a hydraulic roller follower 21, and a push rod 23. An example of a conventional hydraulic roller follower (also frequently referred to herein as a "cam follower"), not having valve deactivation capability, is illustrated and described in U.S. Pat. No. 4,607,599, assigned to the assignee of the present invention and incorporated herein by reference. The cam 19 includes a lift portion 25 and a dwell (base circle) portion 27. The poppet valve assembly 17 includes a poppet valve 29, operable to control flow to and from a combustion chamber 30, and further includes a spring 31 which biases the poppet valve toward the closed position shown in FIG. 1, as is well known to those skilled in the art.

The rocker arm assembly 15 includes a rocker arm 33 of the center-pivot type, the rocker arm 33 including one end 35 which is adapted to receive cyclical input motion from the push rod 23, and another end 37 which is adapted to transmit to the valve 29 the cyclical motion of the push rod 23. As a result, the engine poppet valve 29 has a cyclical opening and closing motion, corresponding to that of the push rod 23, all of which is well known to those skilled in the art. In the subject embodiment, the only motion of the rocker arm 33 is its pivotal movement, with the ends 35 and 37 engaging in alternating up and down movement.

The rocker arm 33 includes a pivot portion 39, disposed intermediate the ends 35 and 37, and a fulcrum 41 is disposed within the pivot portion 39 in a manner which permits the rocker arm 33 to pivot as described previously. The fulcrum 41 has a threaded mounting bolt 43 extending there through and being in threaded engagement with an internally threaded bore 45 defined by the cylinder head 11A. It should be understood that the present invention is not limited to any particular type or configuration of rocker arm or fulcrum arrangement, nor is the use of the present invention limited to the type of rocker arm which requires the presence of a fulcrum member.

Figure 2:
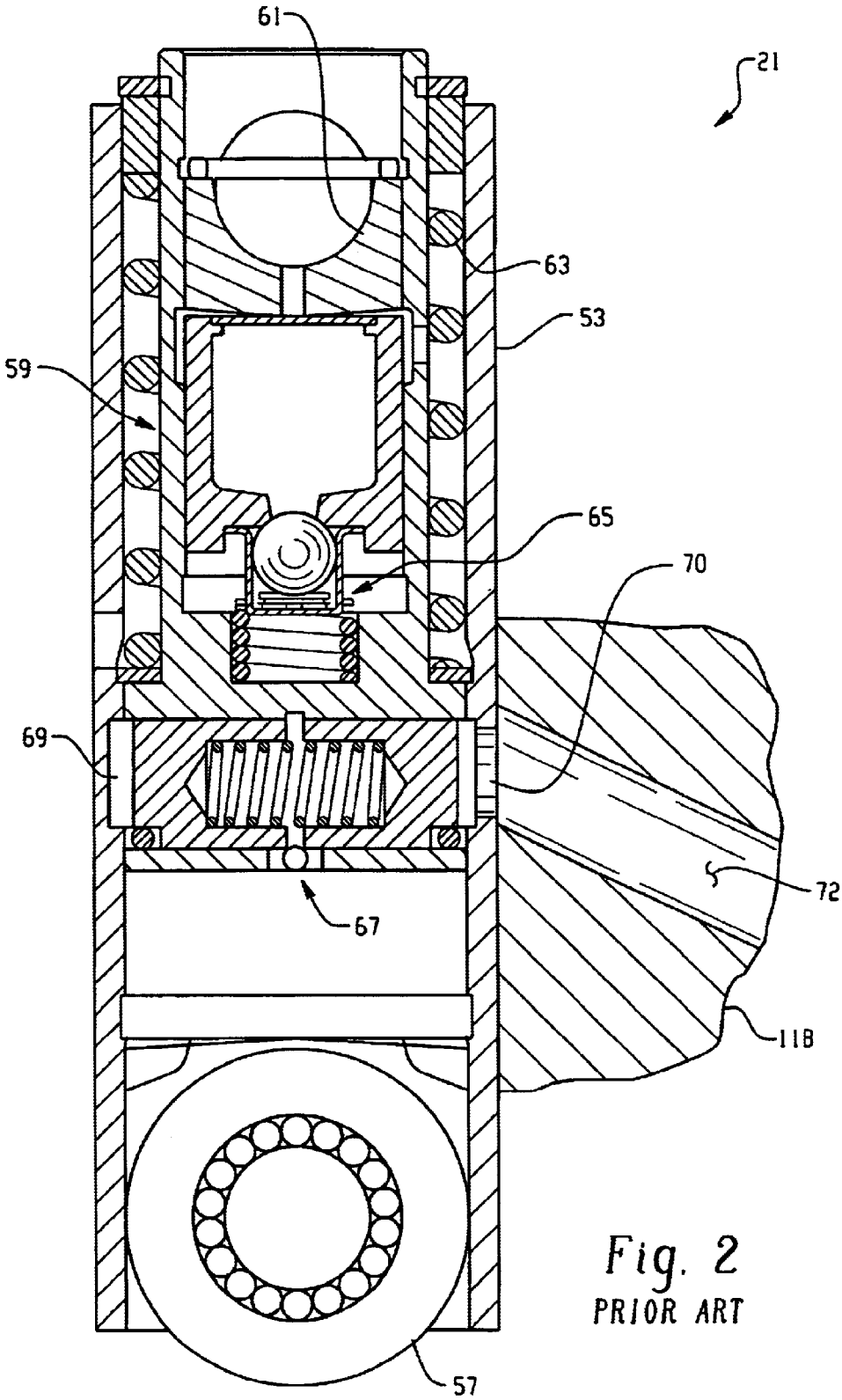
Fig. 2 PRIOR ART
FIG. 2 is a substantially enlarged, axial cross section illustrating a valve deactivating cam follower of the type ("Prior Art") which may utilize the present invention.

Referring now to FIG. 2, in conjunction with FIG. 1, the hydraulic roller follower 21 of the type which may utilize the present invention will be described, the roller follower 21 also being referred to hereinafter as a "valve deactivation assembly", bearing the same reference numeral. Each roller follower 21 includes an outer body member 53 which is disposed to reciprocate within a bore 55 (see FIG. 1) in the engine block 11B. The outer body member 53 is in contact with, and follows its respective cam 19, through a conventional roller 57, shown herein in FIG. 2 as being of the needle roller bearing type. Those skilled in the art will understand that the invention is not limited to any particular roller follower design, or, by way of example, whether the axle of the roller is provided with needle bearings or merely a bushing, etc. Reciprocally disposed within the outer body member 53 is an inner body member 59 which includes a socket portion 61, the function of which is to engage the lower end of the push rod 23. The inner body member 59 is biased upwardly in FIGS. 1 and 2 toward its normal operating position by means of a lost motion spring 63.

Operably associated with the inner body member 59 is a hydraulic lash compensation element, generally designated 65, the details of which are well known to those skilled in the art, are not essential to the present invention, and therefore, will not be described further herein. Also operably associated with the inner body member 59 is a latching mechanism, generally designated 67. The mechanism 67 is of the spring-applied, pressure-released type. Therefore, the outer body member 53 defines an annular pressure passage 69 which is in fluid communication through a port 70 (see FIGS. 2 and 3) with a source (not shown herein) of control pressure by means of an appropriate pressure passage 72 (see FIG. 2) in the engine block 11B, the pressure passage 72 also being referred to hereinafter as a "control pressure passage" or as merely a "control passage". To the extent that the details of the construction and the operation of the valve deactivating roller follower 21 are not already well known to those skilled in the art, further understanding may be gained by reference to above-incorporated U.S. Pat. No. 6,196,175.

Figure 3:
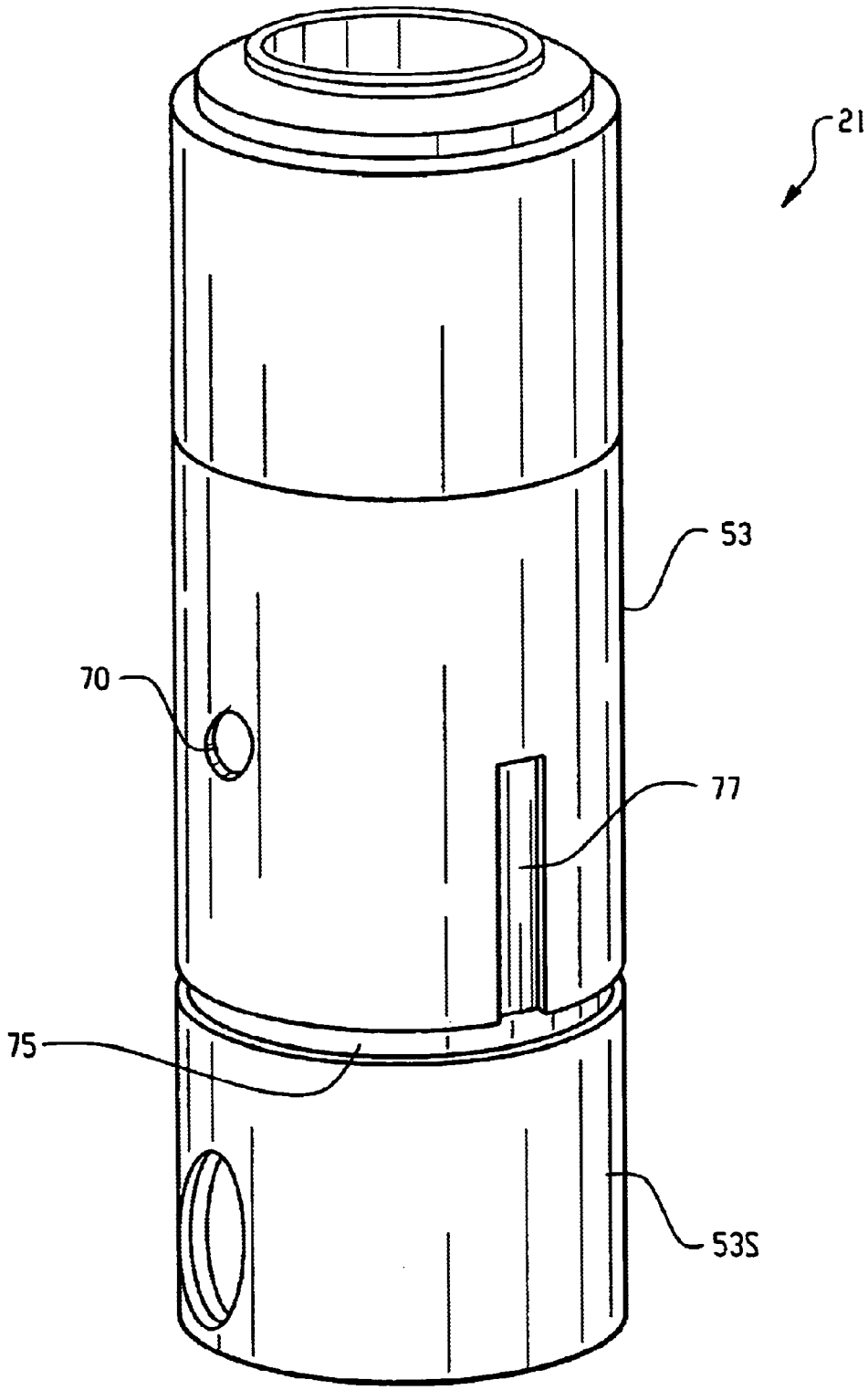
FIG. 3 is a perspective, plan view of a valve deactivating cam follower made in accordance with the present invention, on a larger scale than is shown in FIG. 1, but on a smaller scale than is shown in FIG. 2.
Figure 4:
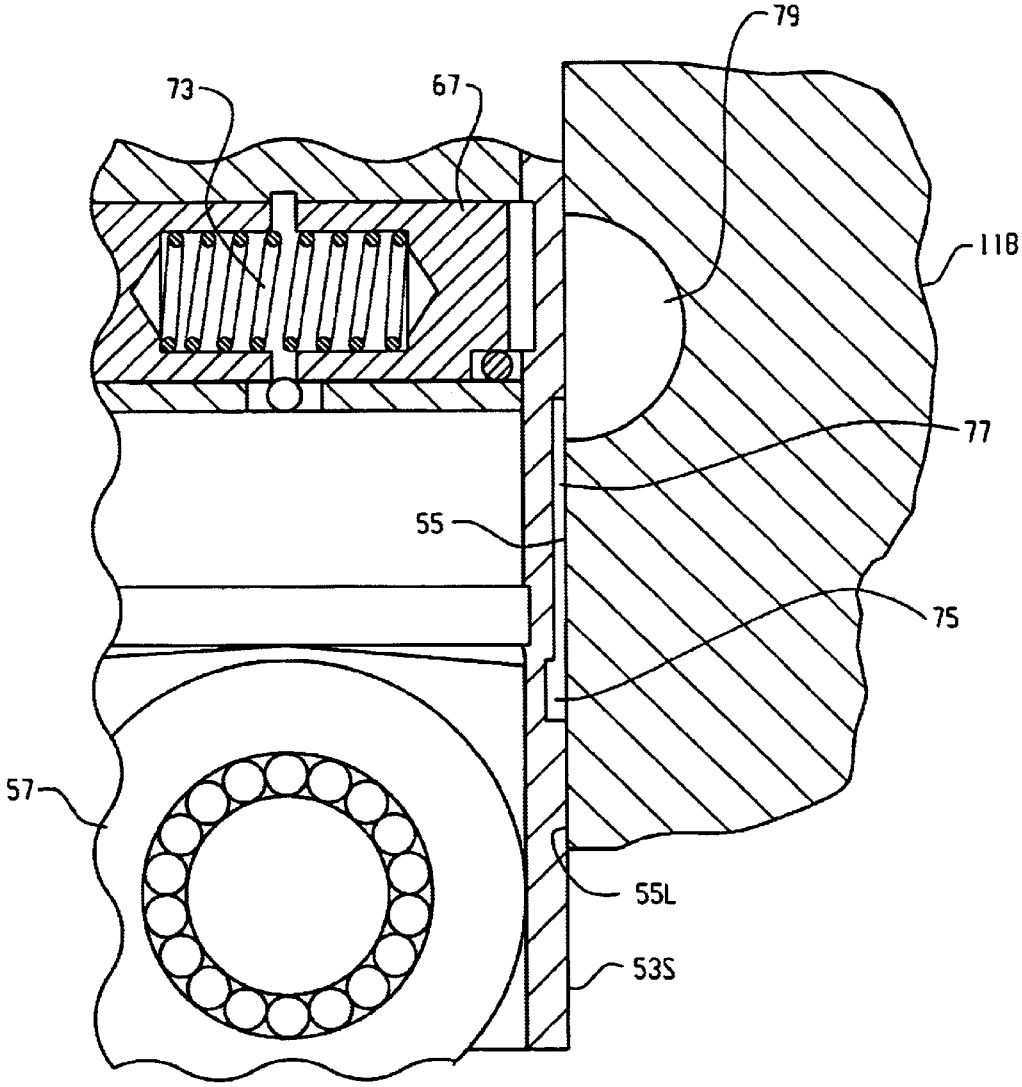
FIG. 4 is a greatly enlarged, fragmentary, axial cross section, similar to FIG. 1, but illustrating certain additional features associated with the invention.

Referring now primarily to FIGS. 3 and 4, it may be seen that the bore 55 includes a lower terminal portion 55L disposed immediately adjacent the generally cylindrical chamber (best shown in FIG. 1) which is defined by the engine block 11B and which surrounds the cam shaft 18. The outer body member 53 of the valve deactivation assembly 21 includes an outer, generally cylindrical surface 53S which remains closely spaced apart, relative to the bore 55, as the outer body member 53 engages in reciprocable movement within the bore 55.

In connection with the development of the present invention, and as was mentioned in the BACKGROUND OF THE DISCLOSURE, it has been observed that, occasionally, the response time of the valve deactivation assembly 21 is much slower than anticipated, and much slower than is required for optimum engine operation. As was also mentioned previously, it has also been observed that such undesirable increases in response time are generally accompanied by the presence of air in the control fluid in the control pressure passage 72. It has now been hypothesized that the air in the control fluid is air which has migrated from the chamber surrounding the cam shaft 18.

In accordance with one aspect of the present invention, it has also now been hypothesized that the engagement of the roller 57 with the profile of the cam 19 (and especially with the lift portion 25) imposes enough of a side load on the valve deactivation assembly 21 that air is permitted to migrate (as it will naturally tend to do) from the chamber surrounding the cam shaft 18 into the small radial clearance between the lower terminal portion 55L of the bore 55 and the outer surface 53S of the outer body member 53. Once air has entered the radial clearance, the subsequent reciprocable movement of the outer body member 53 within the bore 55, in conjunction with the movement resulting from the cyclical side loading imposed by the lift portion 25, permits the upward migration of the air toward the control pressure passage 72. It is also now believed that such reciprocable movement of the outer body member 53 may, with sufficient clearance and side loading, effectively act to "pump" the air through the clearance between the bore 55 and the outer surface 53S, until the air enters the control pressure passage 72. As is well known to those skilled in the art, an air bubble or air pocket within the control fluid can prevent, or at least delay, the disengagement of the latching mechanism 67 from its normal latched condition to the unlatched condition (shown in FIG. 4), in opposition to the biasing force of a compression spring 73.

Referring again primarily to FIGS. 3 and 4, and in accordance with another aspect of the present invention, the outer surface 53S of the outer body member 53 defines an annular groove 75 which, in the subject embodiment, extends about the entire circumferential extent of the outer surface 53S. However, it will be understood by those skilled in the art that in certain applications, it may be sufficient for the annular groove 75 (also referred to herein as a "sealing groove", and in the appended claims, as a "fluid chamber") to extend circumferentially somewhat less than the full circumference of the outer surface 53S. It is believed to be within the ability of those skilled in the art, based upon a reading and understanding of the present specification, to determine the minimum circumferential extent and configuration of the annular sealing groove 75 which is required to achieve the desired object to be described further subsequently.

Referring still to FIGS. 3 and 4, in open communication with the annular sealing groove (or fluid chamber) 75 is an axially extending fluid passage 77, the function of which is to communicate pressurized fluid from a source of relatively low pressure fluid, represented herein by a bore or passage 79 which is shown as being tangential to the bore 55. In accordance with an important aspect of the invention, the purpose of the pressurized fluid being communicated into the annular groove 75 is to form a "seal" or a "barrier" to prevent any substantial passage of air from the lower terminal portion 55L of the bore 55 upward toward the control passage 72. In order to accomplish the described function, it is important that the annular groove 75 be located on the outer surface 53S of the outer body member 53 in such an axial position that, as the outer body member 53 reciprocates within the bore 55, the annular sealing groove 75 never travels down below the lower terminal portion 55L, which would permit the annular groove 75 to be in communication with the air in the chamber surrounding the cam shaft 18. Furthermore, the annular sealing groove 75 should always remain below the lowest portion of the control pressure passage 72, so that the annular groove 75 is always between the source of air and the control passage 72.

Once the axial position of the annular groove 75 along the outer surface 53S has been established, to meet the criteria described above, the axial extent of the fluid passage 77 can then be established to achieve its function, i.e., to provide fluid communication, at least intermittently, between the source of relatively low pressure fluid 79 and the annular groove 75, as the outer body member 53 engages in its reciprocable movement within the bore 55. It is believed to be within the ability of those skilled in the art to select the specific dimensions, cross-sectional area, etc. for the annular groove 75 and the fluid passage 77 so that the function described above is achieved, but without the creation of an excessive, undesirable leakage path. It should be noted that in FIG. 3, and for ease of illustration, the port 70 and the fluid passage 77 are shown as being disposed about 90 degrees apart, circumferentially. However, it is preferred, in terms of the required fluid passages, etc., that the port 70 and the fluid passage 77 be disposed diametrally opposite to each other, i.e., about 180 degrees apart.

As is well known to those skilled in the art, the source 79 of relatively low pressure fluid would typically be the source of engine lubrication fluid, or engine oil gallery, which has the advantage of being a generally constant, continuous source of fluid pressure, wherein the pressure level is somewhat predictable. Thus, although within the scope of the present invention, the control pressure from the control passage 72 could be utilized to pressurize the sealing groove 75, such is less preferred because the control pressure is not constant. Control pressure is, for a time, in a relatively "high" pressure condition in order to unlatch the latching mechanism 67, and then, for a time, in a relatively "low" pressure condition (which could be substantially zero pressure) to permit the latching mechanism to return to the latched state. The source 79 has been referred to herein as being a source of relatively "low pressure", just to distinguish from the control pressure, and to indicate that, in order for the present invention to achieve its desired function, there must be at least some predetermined, minimum pressure (and flow capacity) present at the source 79.

As was stated previously in connection with the description of the annular sealing groove 75, it may be possible, in some applications for the groove 75 to have a circumferential extent of less than 360 degrees. What is important to the present invention is that any "gap" in the circumferential extent of the groove 75 be such that the amount of air which can migrate from the chamber surrounding the camshaft 18 to the control pressure passage 72 is not enough to cause any substantial change in the response time of the valve deactivator assembly 21. As noted previously, "response time" can refer either to the time required for the valve deactivator assembly to change from latched to unlatched, or to the time required to change from unlatched to latched.

Although the present invention has been described in connection with a preferred embodiment, in which the outer surface 53S of the outer body member 53 defines the annular sealing groove 75 and the fluid passage 77, it should be understood that the invention is not so limited. Therefore, references hereinafter, and in the appended claims, to the body member 53 or its outer surface 53S "defining" a fluid chamber (sealing groove 75) will be understood to mean and include the groove 75 being defined by the bore 55 of the engine block 11B. Independently of how the sealing groove 75 is defined, it should also be clear that the fluid passage 77 could also be defined by either the outer surface 53S or by the bore 55, as long as the ultimate purpose is achieved of creating a seal or barrier to prevent passage of air into the control pressure fluid.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A valve deactivation assembly for an internal combustion engine of the type having valve means for controlling flow to and from a combustion chamber; drive means for providing cyclical motion for opening and closing said valve means in timed relationship to the events in said combustion chamber; valve gear train operative in response to said cyclical motion to effect cyclical opening and closing of said valve means; said valve deactivation assembly comprising part of said valve gear train and being disposed in a bore defined by said internal combustion engine, and including latching means shiftable between latched and unlatched conditions in response to the presence of a control fluid pressure in a control passage intersecting said bore; and said valve deactivation assembly including an outer body member disposed for reciprocable movement in said bore in response to said cyclical motion of said drive means; characterized by:

(a) said bore defining a lower, terminal portion disposed adjacent said drive means;

(b) said outer body member defining on its outer surface a fluid chamber extending about substantially the entire circumferential extent of said outer surface, said fluid chamber remaining aligned with said bore, between said lower, terminal portion of said bore and said control passage as said outer body member engages in said reciprocable movement; and (c) one of said outer body member and said bore defining a fluid passage disposed to communicate between a source of fluid pressure and said fluid chamber to form a barrier to substantially block the migration of air from said lower, terminal portion of said bore to said control passage in association with said reciprocable movement of said outer body member.

2. A valve deactivation assembly as claimed in claim 1, characterized by said valve means comprising an intake poppet valve and said drive means comprising a cam shaft defining a base circle portion and a lift portion.

3. A valve deactivation assembly as claimed in claim 1, characterized by said valve gear train comprises a rocker arm in operable engagement with said valve means and a push rod in operable engagement with said rocker arm and said valve deactivation assembly.

4. A valve deactivation assembly as claimed in claim 3, characterized by said assembly further comprising an inner body member disposed within said outer body member and reciprocable relative thereto, said inner body member being in engagement with said push rod.

5. A valve deactivation assembly as claimed in claim 1, characterized by said latching means including a latch member biased radially outward toward said latched condition by a biasing spring and biased radially inward toward said unlatched condition by the presence of said control fluid pressure in said control passage.

6. A valve deactivation assembly as claimed in claim 1, characterized by said fluid chamber comprising an annular groove defined by said outer surface of said outer body member, said annular groove extending about the entire circumference of said outer surface.

7. A valve deactivation assembly as claimed in claim 1, characterized by said fluid passage comprising an axially extending passage formed on said outer surface of said outer body member, and said source of fluid pressure comprising a constant source of relatively low pressure lubrication fluid.

* * * * *